US005206966A

United States Patent [19]

Hoffman

[11] Patent Number: 5,206,966

[45] Date of Patent: May 4, 1993

[54] CARPENTRY TOOL

[76] Inventor: William D. Hoffman, 1440 Faires Rd., Rock Hill, S.C. 29730

[21] Appl. No.: 818,253

[22] Filed: Jan. 8, 1992

[51] Int. Cl.[5] ..... B66F 15/00

[52] U.S. Cl. ..... 7/166

[58] Field of Search ..... 7/166; 254/1, 26 R, 254/88

[56] References Cited

U.S. PATENT DOCUMENTS 4,260,135 4/1981 Dickey ..... 254/1

4,785,488 11/1988 Schellas ..... 7/166

*Primary Examiner*—James G. Smith

*Attorney, Agent, or Firm*—Leon Gilden

[57] ABSTRACT

A carpentry tool arranged for use as a fulcrum relative to a hammer in a carpentry environment includes a base plate formed with a trapezoidal housing extending partially along a top surface of the base plate, wherein the trapezoidal housing includes a top wall, a forward wall, and rear wall arranged for fulcruming surfaces. The housing includes a side wall orthogonally and coextensively oriented relative to a base plate first end as the housing side wall includes a handle pivotally mounted thereto. The handle is arranged with a longitudinal slot for longitudinal adjustment, as well as pivotal adjustment, of the handle relative to the housing. The handle may be formed with a tubular upper body portion to contain a hand lotion dispensing central cavity directed through a sponge cover.

6 Claims, 4 Drawing Sheets

CARPENTRY TOOL

BACKGROUND OF THE INVENTION

1. Field of the Invention

The field of the invention relates to carpentry apparatus, and more particularly pertains to a new and improved carpentry tool wherein the same is arranged to provide for a fulcruming plate for use by carpenters in removing nails and the like.

2. Description of the Prior Art

Typical claw hammers in their removal of nails are frequently oriented such as to be availed of an appropriate fulcruming surface to remove elongated nails. While various tool apparatus is utilized in a prying and the like relative to various environments, the prior art has not availed itself of a carpentry tool as set forth by the instant invention to provide for a multiplicity of fulcruming surfaces as well as a pry bar in use. Various tools such as exemplified in U.S. Pat. No. 4,809,436 to Crookston setting forth a shingle stripping tool utilizes various prying surfaces.

U.S. Pat. No. 4,433,463 to Duval sets forth a further example of a prying tool arranged to spread various surfaces apart, such as molding from a wall surface.

As such, it may be appreciated that there continues to be a need for a new and improved carpentry tool as set forth by the instant invention which addresses both the problems of ease of use as well as effectiveness in construction in providing a prying surface fulcrum support and in this respect, the present invention substantially fulfills this need.

SUMMARY OF THE INVENTION

In view of the foregoing disadvantages inherent in the known types of carpentry tools now present in the prior art, the present invention provides a carpentry tool wherein the same is arranged to position various prying surfaces relative to a claw hammer in removal of nails and the like, as well as a pry bar in its employment. As such, the general purpose of the present invention, which will be described subsequently in greater detail, is to provide a new and improved carpentry tool which has all the advantages of the prior art carpentry tools and none of the disadvantages.

To attain this, the present invention provides a carpentry tool arranged for use as a fulcrum relative to a hammer in a carpentry environment including a base plate formed with a trapezoidal housing extending partially along a top surface of the base plate, wherein the trapezoidal housing includes a top wall, a forward wall, and rear wall arranged for fulcruming surfaces. The housing includes a side wall orthogonally and coextensively oriented relative to a base plate first end as the housing side wall includes a handle pivotally mounted thereto. The handle is arranged with a longitudinal slot for longitudinal adjustment, as well as pivotal adjustment, of the handle relative to the housing. The handle may be formed with a tubular upper body portion to contain a hand lotion dispensing central activity directed through a sponge cover.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved carpentry tool which has all the advantages of the prior art carpentry tools and none of the disadvantages.

It is another object of the present invention to provide a new and improved carpentry tool which may be easily and efficiently manufactured and marketed.

It is further object of the present invention to provide a new and improved carpentry tool which is of a durable and reliable construction.

An even further object of the present invention is to provide a new and improved carpentry tool which is susceptible of a low cost of manufacture with regard to both materials and labor, and which accordingly is then susceptible of low prices of sale to the consuming public, thereby making such carpentry tools economically available to the buying public.

Still yet another object of the present invention is to provide a new and improved carpentry tool which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
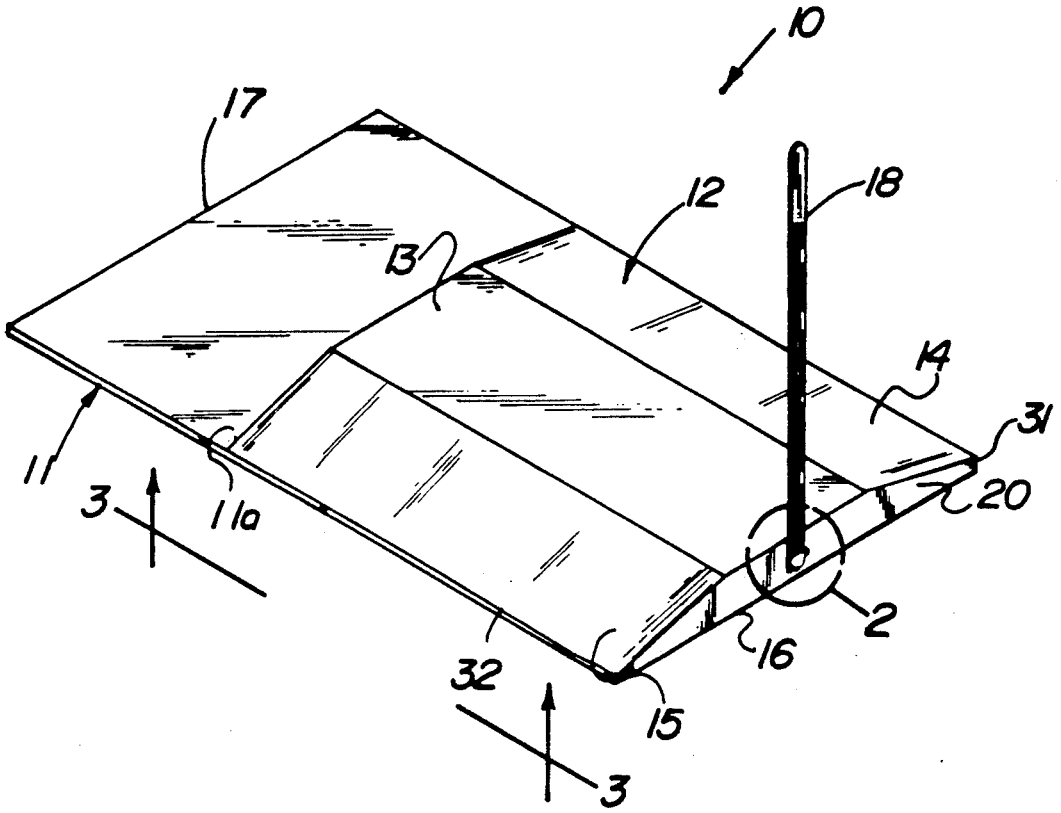
FIG. 1 is an isometric illustration of the instant invention.
Figure 2:
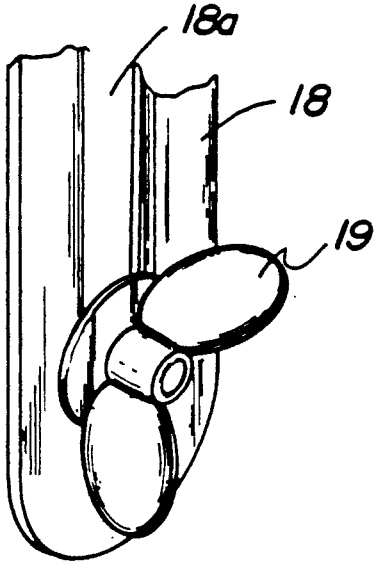
FIG. 2 is an orthographic view, taken of section 2 as set forth in FIG. 1.

With reference now to the drawings, and in particular to FIGS. 1 to 9 thereof, a new and improved carpentry tool embodying the principles and concepts of the present invention and generally designated by the reference numeral 10 will be described.

Figure 3:
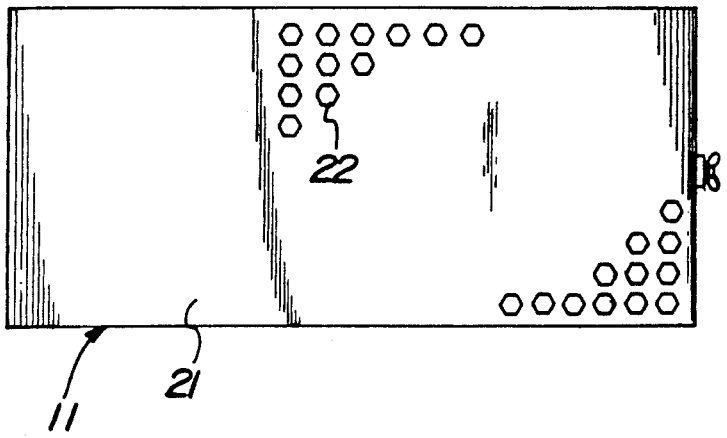
FIG. 3 is an orthographic view, taken along the lines 3—3 of FIG. 1 in the direction indicated by the arrows.

More specifically, the carpentry tool 10 of the instant invention essentially comprises a planar base plate 11 defined by a predetermined first length and a predetermined width. The base plate 11 includes a base plate top surface 11*a* integrally mounting a trapezoidal housing 12 thereon. The base plate includes a first end 16 spaced from an parallel a second end 17, with trapezoidal housing 12 extending from the first end 16 a predetermined second length less than the predetermined first length but equal to a width equal to the predetermined width and coextensively extending between parallel side edges of the base plate. The housing 12 includes a top wall 12 parallel to and spaced above the base plate 11*a* top surface, with a forward wall 14 defining an acute included angle between the forward wall and the base plate top surface, and a rear wall 15 extending from the top wall defining an acute angle between the rear wall and the base plate top surface. The forward wall 14 extends from the top wall to a base plate forward side edge 31, with the rear wall 15 extending from the top wall to a base plate rear side edge 32. A handle 18 is provided to include a handle slot 18*a* longitudinally aligned relative to the handle extending therethrough adjacent a lower distal end of the handle as the slot 18*a* is enclosed to receive a fastener 19 therethrough orthogonally directed into a housing first side wall 20. The housing first side wall 20 is coextensive with the first end 16 and orthogonally oriented relative to the base plate. A base plate bottom surface 21, as illustrated in the FIG. 3, is arranged to provide for a honeycomb interior 22 of the housing 12 to provide for reduced weight of the housing and ease of manipulation in use of the tool 10.

Figure 4:
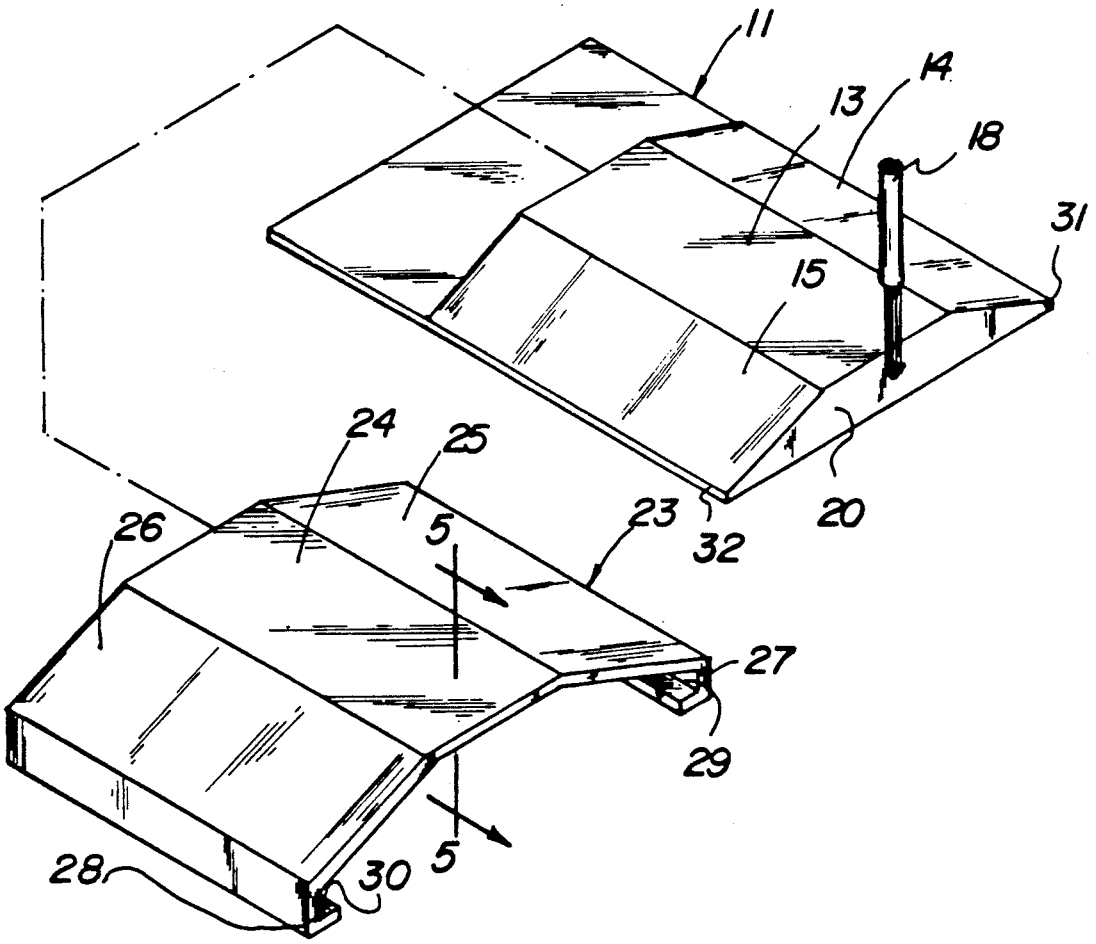
FIG. 4 is an isometric illustration of the tool utilizing a magnetic sheath.
Figure 5:
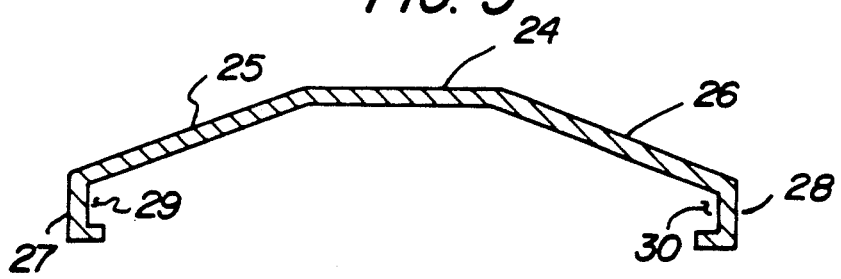
FIG. 5 is an orthographic view, taken along the lines 5—5 of FIG. 4 in the direction indicated by the arrows.

The FIG. 4 illustrates the use of a ferromagnetic cover member 23 arranged to coextensively cover the housing 11 and defined by a length substantially equal to the predetermined second length of the housing, wherein the cover member 23 is slidingly received about the housing and to include a cover member top wall 24, a cover member forward wall 25, and a cover member rear wall 26 to complementarily overlie in a coextensive relationship the respective housing top wall 13, the housing forward wall 14, and the housing rear wall 15 is a contiguous relationship. A forward "L" shaped flange 27 extends downwardly from the forward wall 25, with a rear "L" shaped flange 28 extending downwardly from the rear wall 26 to define a forward slot and rear slot 29 and 30 that are in confronting relationship relative to one another to respectively receive the base plate forward side edge 31 and the base plate rear side edge 32 within the respective forward and rear slots 29 and 30.

Figure 6:
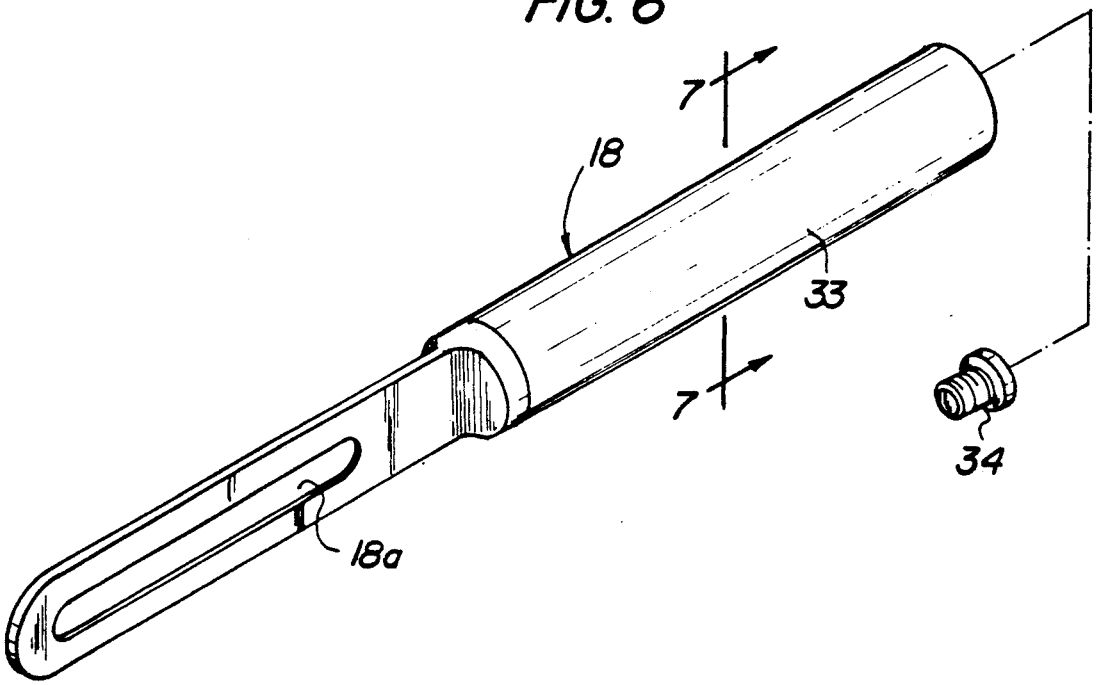
FIG. 6 is an isometric illustration of the handle structure of the invention.
Figure 7:
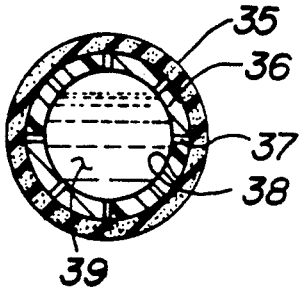
FIG. 7 is an orthographic view, taken along the lines 7—7 of FIG. 6 in the direction indicated by the arrows.

The handle, as illustrated in the FIGS. 6 and 7, is arranged to further include a tubular handle body 13 to include a body core cavity 38 within the tubular handle body. A cap plug 34 is removably mounted within an upper distal end of the core cavity 38 and core cavity 38 is further positioned within a rigid tubular handle body core 36 to include body core apertures directed through the body core 36. In this manner, a fluid lotion 39 is directed within the cavity 38, wherein the lotion 39 is arranged for seepage through the apertures 37 into a resilient and permeable outer handle body covering 35 coextensive with the tubular handle body 33 to provide for a hand lotion to carpenters.

Figure 8:
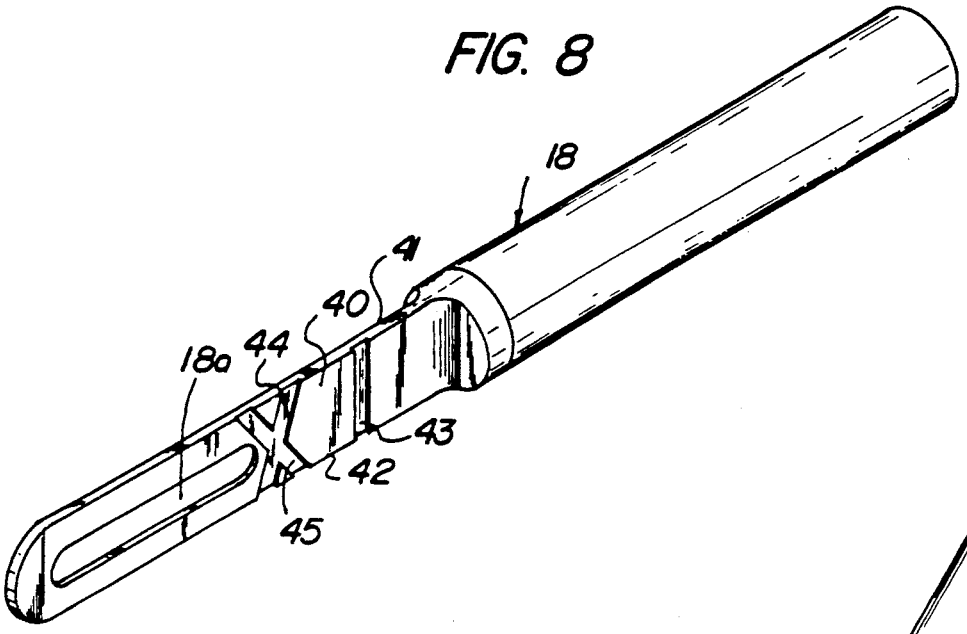
FIG. 8 is an isometric illustration of a modified handle structure.
Figure 9:
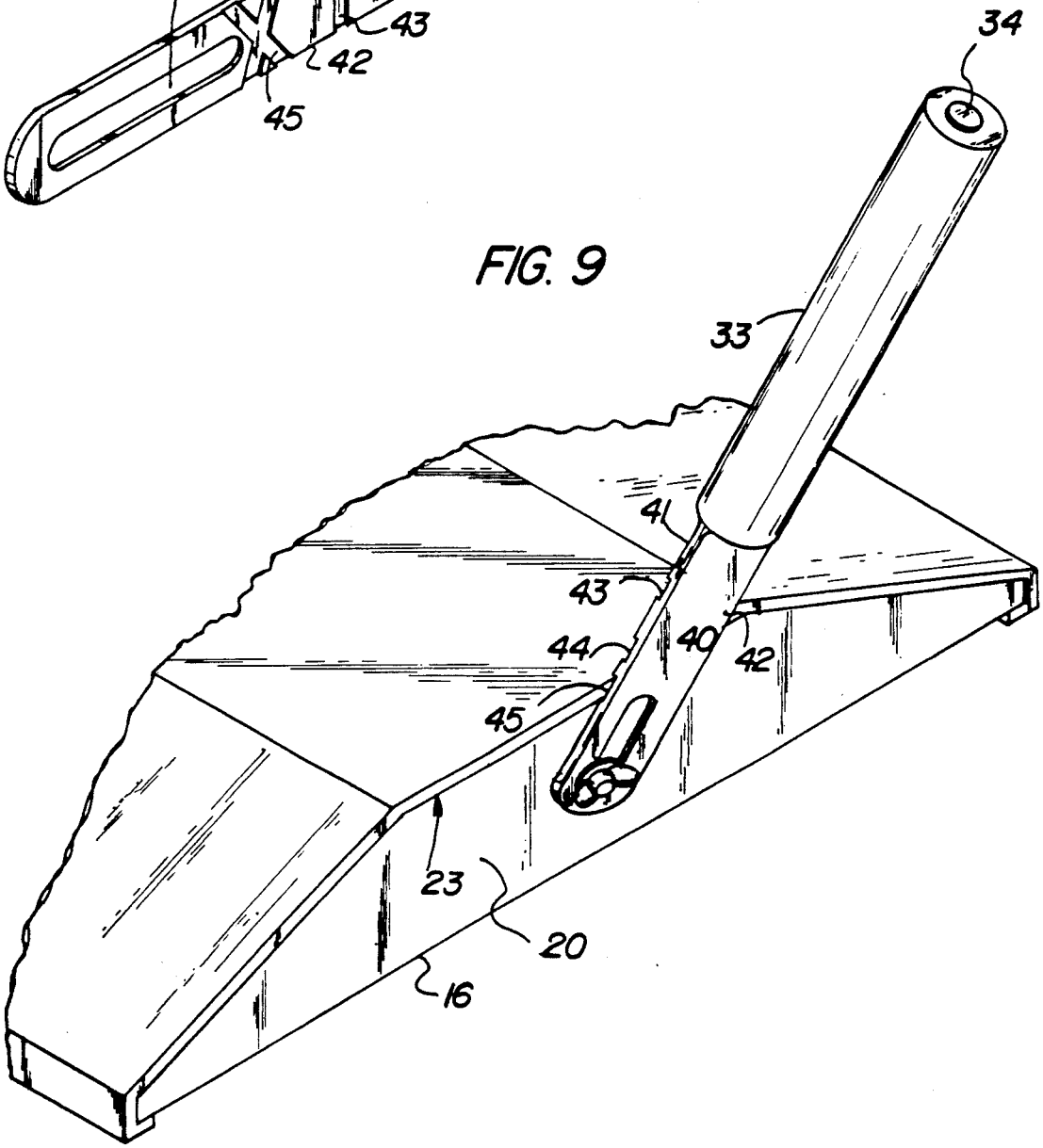
FIG. 9 is an isometric illustration of the modified handle structure in use.

The handle 18, as illustrated in FIGS. 8 and 9, may be further formed with the handle plate 40 positioned below the body 33 coaxially aligned therewith, including the slot 18*a*. The handle plate includes a handle plate first side edge 41 parallel to a handle plate second side edge 42. A first slot 43 is orthogonally directed between the first and second side edges 41 and 42. Respective second and third slots 44 and 45 orthogonally and medially intersect each other and are obliquely oriented relative to the handle plate first and second side edges 41 and 42. In this manner, the respective first, second, and third slots 43, 44 and 45 permit engagement with the cover member 23 extending beyond the housing first side wall 20 to provide for latching and angular alignment of the handle 18 relative to the housing 12 and effect a latching thereof of the handle relative to the housing, as illustrated in FIG. 9 for example, as the edge of the magnetic cover member 23 provides for an engaging edge for the various slots 43, 44, and 45. The magnetic sheath further is arranged to attract nails withdrawn by the tool structure 10 preventing the littering and potential injury availed by the distribution of spent nails about a work site.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be restored to, falling within the scope of the invention.

What is claimed as being new and desired to be protected by Letters Patent of the United States is as follows:

1. A carpentry tool, comprising, a base plate, the base plate including a base plate first end spaced from a base plate second end, and a base plate forward side edge spaced from and parallel a base plate rear side edge, and the base plate extending from the first end to the second end a predetermined first length, and the base plate extending from the base plate forward side edge to the base plate rear side edge a predetermined width, and housing means mounted to the base plate, wherein the housing means is integrally secured to a top surface of the base plate for providing a fulcrum surface, and the housing means includes a housing top wall arranged parallel to and above the base plate, a housing forward wall extending from the top wall to the base plate forward side edge, and a housing rear wall extending from the top wall to the housing rear side edge, wherein the housing includes a housing first side wall orthogonally and coextensively mounted to the base plate first end and extending from the base plate first end a predetermined second length less that the predetermined first length.

2. A tool as set forth in claim 1 wherein a handle is mounted to the housing first side wall, wherein the handle includes an enclosed handle slot longitudinally aligned with the handle, and a fastener directed through the handle slot into the housing first side wall for securement of the handle to the housing first side wall.

3. A tool as set forth in claim 2 further including a ferromagnetic cover member arranged for mounting in contiguous and overlying relationship to the trapezoidal housing, wherein the cover member includes a cover member top wall, a cover member forward wall, and a cover member rear wall, wherein each cover member wall is defined by a length equal to the predetermined second length, wherein the cover member is slidably mounted to a top surface of the trapezoidal housing.

4. A tool as set forth in claim 3, wherein the cover member further includes a forward "L" shaped flange extending downwardly from the forward wall, and a rear "L" shaped edge extending downwardly from the cover member rear wall, wherein the forward "L" shaped flange includes a forward slot to receive the base plate forward side edge therewithin, and the rear "L" shaped flange includes a rear slot to receive the base plate rear side edge therewithin.

5. A tool as set forth in claim 4 wherein the handle includes a tubular handle body positioned above the handle slot, and the handle slot is directed through a handle plate, wherein the handle plate is coaxially aligned relative to the tubular handle body, the tubular handle body including a rigid tubular handle body core, the handle body core including a plurality of apertures directed therethrough, and the handle body core including a core cavity, the core cavity including a fluid lotion positioned therewithin, and further including a cap plug removably mounted to an upper distal end of the handle body core, and the handle body core including a resilient and permeable outer handle body covering coextensively positioned about the handle body core to receive the lotion from the core cavity.

6. A tool as set forth in claim 5 wherein the handle body plate includes a first side edge spaced from and parallel a second side edge, and the handle plate includes a first slot orthogonally directed and coextensive between the handle plate first side edge and the handle plate second side edge, and the handle plate further including a second slot obliquely directed between the handle plate first side edge and the handle plate second side edge, and a third slot medially and orthogonally intersecting the second slot and obliquely oriented between the handle plate first side edge and the handle second side edge, wherein the first slot, the second slot, and the third slot are arranged to selectively receive a cover member forward edge of the cover member when the cover member is spaced forwardly of the housing first side wall.

* * * * *